United States Patent [19]

Nitta

[11] Patent Number: 4,786,248

[45] Date of Patent: Nov. 22, 1988

[54] GASLIGHTER EQUIPPED WITH A SAFETY LOCK

[75] Inventor: Tomio Nitta, Yokohama, Japan

[73] Assignee: Tokai Corporation, Yokohama, Japan

[21] Appl. No.: 110,906

[22] Filed: Oct. 21, 1987

[51] Int. Cl.[4] ..... F23Q 3/01; F23Q 2/16; F23D 11/36

[52] U.S. Cl. ..... 431/255; 431/153; 257/95; 257/111; 222/153; 222/402.11

[58] Field of Search ..... 431/255, 254, 256, 257, 431/153; 222/153, 384, 402.11; 251/95, 111, 113, 319

[56] References Cited

U.S. PATENT DOCUMENTS

| | | | |
|---|---|---|---|
| 2,323,378 | 7/1943 | Champione et al. | 222/384 X |
| 3,828,981 | 8/1974 | Linkletter | 222/153 |
| 3,828,982 | 8/1974 | Steigenwald | 222/153 |
| 4,190,034 | 2/1980 | Wonisch | 431/255 X |
| 4,471,404 | 9/1984 | Nitta | 431/253 X |
| 4,502,465 | 3/1985 | Yoshinaga et al. | 431/253 X |
| 4,591,074 | 5/1986 | Kennings | 222/153 |

*Primary Examiner*—Samuel Scott
*Assistant Examiner*—Carl D. Price
*Attorney, Agent, or Firm*—Armstrong, Nikaido, Marmelstein & Kubovcik

[57] ABSTRACT

Disclosed is a piezoelectric type gaslighter equipped with a thumb-latch for preventing an inadvertent fire which may be caused, for instance, when a child plays with a gaslighter. A gaslighter according to the present invention includes an intermediate casing and a piezoelectric unit having a movable operating part. The intermediate casing has a cross slot opening with a thumb-latch slidably fitted therein whereas the movable operating part has a longitudinal slot groove. The piezoelectric unit is properly inserted in the intermediate casing so that the longitudinal slot groove of the movable operating part intersects the cross slot opening of the casing. With this arrangement when the thumb-latch is displaced to the crossing at which the longitudinal slot groove intersects the cross slot opening, the movable operating part can move to strike the piezoelectric element for producing a small flame. Otherwise, the movable operating part is latched.

1 Claim, 1 Drawing Sheet

GASLIGHTER EQUIPPED WITH A SAFETY LOCK

BACKGROUND OF THE INVENTION

1. Field of the Invention

The present invention relates to an improvement of gaslighter equipped with a piezoelectric flint system, and more particularly to an improvement of the operating mechanism in the piezoelectric flint system.

2. Prior Art

As is well known a conventional piezoelectric type gaslighter includes a piezoelectric flint system. It comprises a piezoelectric element and a striker which is responsive to external force or push for striking the piezoelectric element, thereby providing a small flash of flame. Specifically, the striker is operatively connected to a movable operating part of the flint system, which part is resiliently biased and is adapted to yieldingly withdraw when external force is applied thereto against its resilient bias, thereby storing and then releasing through the agency of the striker the energy enough to cause the piezoelectric element to generate piezoelectricity for ignition. Also the movable operating part is connected to a valve for controlling the flow of gas from the gas storage, thereby permitting the valve to open at the right moment when the piezoelectric element is struck to generate piezoelectricity for ignition. Thus, when ejecting from the nozzle of the valve the gas starts to burn.

The gaslighter is responsive to a push to its movable operating part for producing a flame. In this connection, there is a fear of a fire which shall be caused by a child playing with the gaslighter.

SUMMARY OF THE INVENTION

In view of the above, one object of the present invention is to provide a gaslighter equipped with a lock system which prevents the lighting operation of the gaslighter when locked.

To attain this object, a gaslighter according to the present invention comprises a gas storage having a reentrant top cover; a valve communicating with the gas storage for controlling the flow of gas; an intermediate casing having a reentrant part fitted in the reentrant space of the top cover and having a cross slot and a thumb-latch slidably movable therein; a thumb-operated piezoelectric unit having a movable operating part responsive to a thumb-push against its resilient bias for generating piezoelectricity, said thumb-operated piezoelectric unit being partly inserted in the reentrant space of the intermediate casing; a thumb-pusher fixed to the top of the thumb-operated piezoelectric unit and slidably fitted in the intermediate casing, said thumb-pusher having a longitudinal slot perpendicular to the cross slot of the intermediate casing, the cross slot of the intermediate casing and the longitudinal slot of the thumb-pusher being so positioned that when the thumb-latch is displaced to the crossing at which the cross slot and the longitudinal slot intersect, the thumb-latch does not prevent the descent of the movable part of the piezoelectric unit for ignition, and that when the thumb-latch is displaced to a different position other than the crossing the thumb-latch catches the thumb-pusher, thereby preventing descent of the movable part of the piezoelectric unit for ignition; and a linkage connecting the valve with the movable operating part of the thumb-operated piezoelectric unit for opening the valve in response to the descent of the movable operating part of the piezoelectric unit.

In locking the gaslighter it sufficies that the thumb-latch is displaced in the cross slot of the intermediate casing to a different position other than the crossing at which the cross slot and the longitudinal slot interest. Then, the thumb-latch can catch the bottom edge of the thumb-pusher, thereby preventing descent of the movable operating part of the piezoelectric unit for ignition. In unlocking the thumb-latch is displaced to the crossing, and then the thumb-latch does not prevent the descent of the movable part of the piezoelectric unit for ignition.

Other objects and advantages will be apparent from the following description of a preferred embodiment, which is shown in the accompanying drawings:

PREFERRED EMBODIMENT OF THE INVENTION

Figure 1:
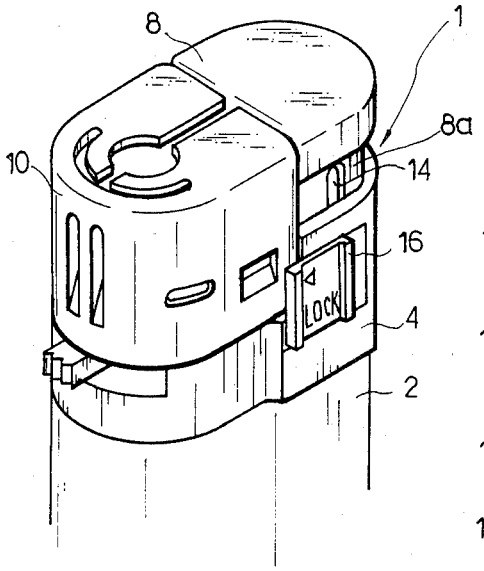
FIG. 1 is a perspective view of the top part of a gaslighter according to the present invention.
Figure 2:
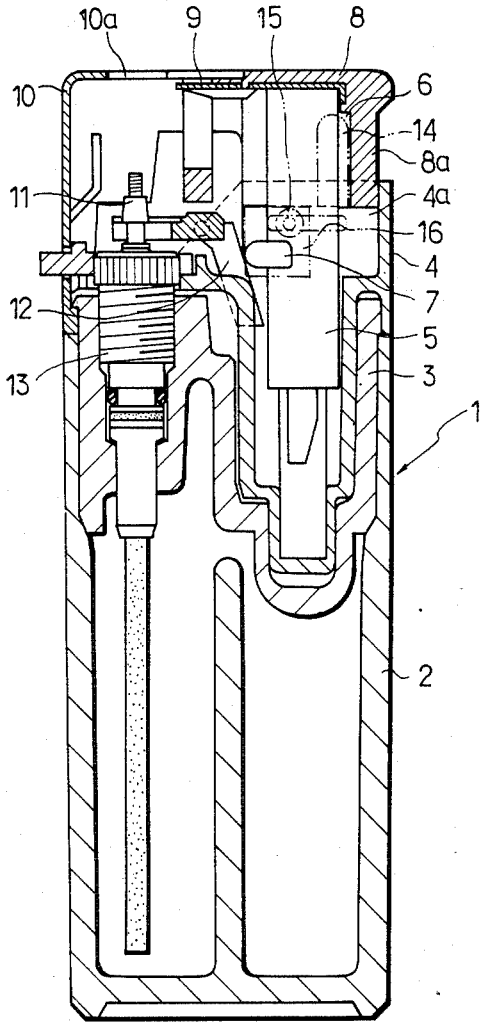
FIG. 2 is a longitudinal section of the gaslighter.

Referring to the drawings, a gaslighter according to the present invention is generally indicated at 1. It includes a gas storage 2 having a reentrant hollow space in a top cover 3 and an intermediate casing 4 having a reentrant or protruding part fitted in the reentrant space of the top cover 3. A thumb-operated piezoelectric unit 5 has a movable operating part responsive to a thumb-push against its resilient bias for generating piezoelectricity. As shown the thumb-operated piezoelectric unit 5 is partly inserted in the reentrant space of the intermediate casing 4. The thumb-operated piezoelectric unit 5 comprises a piezoelectric element and a striker (not shown), which is responsive to external force or push for striking the piezoelectric element, thereby generating a high potential between terminals 6 and 7.

As shown, the thumb-operated piezoelectric unit 5 is pushed into the reentrant space of the intermediate casing 4, leaving the upper half of the unit exposed above the intermediate casing. A thumb-pusher 8 is attached to the movable operating part of the thumb-operated piezoelectric unit 5.

An extended electrode 9 is connected to one terminal 6 of the piezoelectric unit, and the electrode is sandwiched between the thumb-pusher 8 and the movable operating part of the piezoelectric unit. The side wall 8*a* of the thumb-pusher 8 is slidably fitted in the intermediate casing 4 whereas the top end of the thumb-pusher 8 is caught by a windshield 10, thereby preventing the thumb-pusher from slipping off from the intermediate casing 4.

The gas-ejecting nozzle 11 is directed to the flame opening 10*a* of the windshield 10. An operating lever 12 is made of an electrically conductive material, and is responsive to the descent of the movable operating part of the piezoelectric unit for raising the gas-ejecting nozzle 11, thereby opening the valve 13 for ejection of gas. Specifically, when the thumb-pusher 8 is pushed down by thumb, the movable operating part of the piezoelectric unit is accordingly lowered, and then the terminal 7 of the piezoelectric unit is put in contact with the operating lever 12. After the operating lever 12 is moved to open the valve 13, the piezoelectric generator produces piezoelectricity at an increased voltage to cause an electric arc to appear between the tip of the nozzle 11 and the extended electrode 9, thereby producing a flame.

Figure 3:
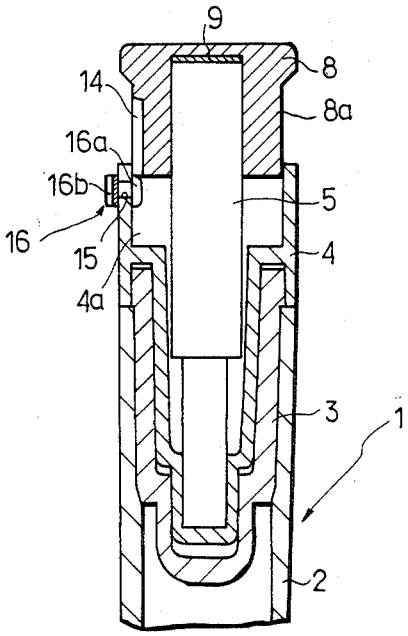
FIG. 3 shows, partly in section, the part of the gaslighter including a locking mechanism.

As shown, the side wall 8*a* of the thumb-pusher 8 has a longitudinal groove 14 made therein. The longitudinal slot 14 extends in the direction in which the movable operating part can move to open at the bottom edge of the side wall 8*a*. On the other hand, the side wall 4*a* of the intermediate casing 4 has an elongated cross slot opening 15 made therein. The cross slot opening 15 intersects the longitudinal groove 14 of the thumb-pusher 8 in the vicinity of the open end of the longitudinal groove 14. A thumb-latch 16 is slidably fitted in the elongated cross slot opening 15 of the intermediate casing 4 with its opposite heads 16*a* and 16*b* pinching the thickness of the intermediate casing wall. When the thumb-latch 16 is displaced along the elongated cross slot opening 15 to the crossing at which the cross slot opening 15 intersects the longitudinal groove 14, one head 16*a* of the thumb-latch 16 is positioned in alignment with and at the open lower end of the longitudnal groove 14. When the thumb-latch 16 is displaced to the opposite end of the cross slot, the head 16*a* of the thumb-latch 16 is out of alignment with the longitudinal slot 14 and in contact with the bottom edge of the side wall 8*a* of the thumb-pusher 8. As best shown in FIG. 3, the other head 16*b* of the thumb-latch 16 appears on the intermediate casing, thereby permitting the thumb-latch 16 to slide in the cross slot 15 by thumb.

In use when the thumb-latch 16 is displaced to the crossing at which the longitudinal groove 14 of the thumb-pusher 8 intersects the cross slot opening 15 of the intermediate casing 4, the thumb-pusher 8 can be pushed down with one head 16*a* of the thumb-latch 16 in the descending longitudinal groove 14. When the thumb-latch 16 is displaced to any other than in alignment with the longitudinal slot 14 at the crossing, the head 16*a* of the thumb-latch 16 is brought in contact with the bottom edge 8*a* of the side wall of the thumb-pusher 8, thereby preventing the descent of the thumb-pusher 8.

As may be understood from the above, a gaslighter according to the present invention when latched will be guaranteed free of an inadvertent fire which might be caused for instance when a child plays with the gaslighter.

I claim:

1. A gaslighter comprising: gas storage means having a reentrant space in a top cover; a valve communicating with the gas storage for controlling the flow of gas; an intermediate casing having a protruding part fitted in the reentrant space of the top cover, said intermediate casing having a cross slot opening passing from an interion surface to an exterior surface thereof, a thumb-latch slidably movable in said cross slot opening, the thumb-latch having a head portion adjacent to the interior surface of said intermediate casings; a piezoelectric unit having a movable operating part for generating piezoelectricity, said piezoelectric unit having a top portion and a bottom portion, said bottom portion of said piezoelectric unit being inserted in a hollow interior portion of the protruding part of the intermediate casing and having resilient bias means to resiliently bias said piezoelectric unit outwardly with respect to the hollow interior portion; a thumb-pusher fixed to the top of the piezoelectric unit and slidably fitted in the intermediate casing, said thumb-pusher having an outer surface, said outer surface having a longitudinal groove arranged adjacent and perpendiculr to a portion of the cross slot opening of the intermediate casing, the cross slot opening of the intermediate casing and the longitudinal groove of the thumb-pusher being so positioned that when the head portion is displaced to a position in the cross slot opening in alignment with the longitudinal groove the thumb pusher will pass the head portion and move the movable part of the piezoelectric unit against said resilient bias means, and when the thumb-latch is displaced to a different position where the head portion is not aligned with the longitudinal groove the head portion will engage a surface of the thumb-pusher, thereby preventing movement of the thumb-pusher and the movable operating part of the piezoelectric unit; and a linkage connecting the valve with the movable operating part of the piezoelectric unit for opening the valve in response to movement of the movable operating part of the piezoelectric unit by the thumb-pusher.

* * * * *